US008465222B1

(12) United States Patent
Ghauch et al.

(10) Patent No.: US 8,465,222 B1
(45) Date of Patent: Jun. 18, 2013

(54) LOAD TRANSFER APPARATUS FOR CAST-IN-PLACE CONCRETE SLABS

(76) Inventors: Ziad Ghauch, Byblos (LB); Hadi Ghauch, Stockholm (SE)

( * ) Notice: Subject to any disclaimer, the term of this patent is extended or adjusted under 35 U.S.C. 154(b) by 0 days.

(21) Appl. No.: 13/424,215

(22) Filed: Mar. 19, 2012

(51) Int. Cl.
*E01C 11/14* (2006.01)

(52) U.S. Cl.
USPC ..... 404/51; 404/52; 404/56; 404/60; 404/61; 404/62

(58) Field of Classification Search
USPC ..... 404/49, 51, 52, 56, 59, 60, 61, 62, 404/63
See application file for complete search history.

(56) References Cited

U.S. PATENT DOCUMENTS

| | | | | |
|---|---|---|---|---|
| 3,329,072 | A * | 7/1967 | Rice | 404/59 |
| 4,733,513 | A | 3/1988 | Schrader et al. | |
| 5,934,821 | A * | 8/1999 | Shaw et al. | 404/62 |
| 6,145,262 | A | 11/2000 | Schrader et al. | |
| 6,354,760 | B1 | 3/2002 | Boxall et al. | |
| 6,502,359 | B1 * | 1/2003 | Rambo | 52/396.04 |
| 6,517,277 | B2 * | 2/2003 | Hu et al. | 403/294 |
| 6,926,463 | B2 * | 8/2005 | Shaw et al. | 404/60 |
| 7,201,535 | B2 * | 4/2007 | Kramer | 404/52 |
| 7,314,333 | B2 * | 1/2008 | Shaw et al. | 404/60 |
| 7,338,230 | B2 * | 3/2008 | Shaw et al. | 404/58 |
| 7,381,008 | B2 * | 6/2008 | Shaw et al. | 404/60 |
| 7,441,984 | B2 * | 10/2008 | Kramer | 404/52 |
| 7,481,031 | B2 | 1/2009 | Boxall et al. | |
| 7,716,890 | B2 | 5/2010 | Boxall et al. | |
| 2007/0231068 | A1 * | 10/2007 | Francies et al. | 404/56 |
| 2008/0014018 | A1 | 1/2008 | Boxall | |

* cited by examiner

*Primary Examiner* — Gary Hartmann

(57) ABSTRACT

A tapered dowel bar for transferring loads across a joint between adjacent concrete slabs is disclosed. The dowel tapers from one relatively wide cross section into one or more relatively narrow ends. The shape of the dowel is optimized to provide the highest amount of steel along the joint where the loads are highest. The tapered dowel is embedded in one or both sides into a socket assembly that connects the dowel to essentially planar top and bottom surfaces of a pocket former embedded in the concrete. The load transfer assembly restricts any relative vertical displacement between the first and second slabs. The socket assembly embedded in the pocket former or equipped with compressible material accommodates relative horizontal movement between adjacent slabs in directions essentially parallel and perpendicular to the joint.

20 Claims, 9 Drawing Sheets

LOAD TRANSFER APPARATUS FOR CAST-IN-PLACE CONCRETE SLABS

FEDERALLY SPONSORED RESEARCH non-applicable

SEQUENCE LISTING OR PROGRAM non-applicable

U.S. PATENT DOCUMENTS

| | | | |
|---|---|---|---|
| 0,232,697 | A1 | October 2005 | Brinkman |
| 0,204,558 | A1 | September 2007 | Carroll |
| 0,014,018 | A1 | January 2008 | Boxall et al. |
| 0,054,858 | A1 | March 2010 | Mayo et al. |
| 2,096,702 | A | October 1937 | Yeoman |
| 2,164,590 | A | July 1939 | Oates |
| 2,255,599 | A | September 1941 | Olmsted |
| 2,500,262 | A | March 1950 | Parrott |
| 6,171,016 | B1 | January 2001 | Pauls et al. |
| 6,386,774 | B1 | May 2002 | Carpenter |
| 6,447,203 | B1 | September 2002 | Ruiz et al. |
| 7,481,031 | B2 | January 2009 | Boxall et al. |
| 7,716,890 | B2 | May 2010 | Boxall et al. |
| 3,104,600 | A | September 1963 | White |
| 4,733,513 | A | March 1988 | Schrader et al. |
| 4,996,816 | A | March 1991 | Wiebe |
| 5,797,231 | A | August 1998 | Kramer |
| 6,019,546 | A | February 2000 | Ruiz |
| 6,145,262 | A | November 2000 | Schrader et al. |
| 6,354,760 | B1 | March 2002 | Boxall et al. |
| 7,201,535 | B2 | April 2007 | Kramer |
| 7,338,230 | B2 | March 2008 | Shaw et al. |
| 7,441,985 | B2 | October 2008 | Kelly et al. |
| 7,481,031 | B2 | January 2009 | Boxall et al. |
| 7,637,689 | B2 | December 2009 | Boxall et al. |
| 7,716,890 | B2 | May 2010 | Boxall et al. |
| 7,874,762 | B2 | January 2011 | Shaw et al. |

FOREIGN PATENT DOCUMENTS

| | | |
|---|---|---|
| DE | 726829 | September 1942 |
| EP | 0059171 | September 1982 |
| EP | 0328484 A1 | August 1989 |
| GB | 2285641 A | July 1995 |

OTHER PUBLICATIONS

Friberg, B. F. (1938). "Design of dowels in transverse joints of concrete pavements." Trans., ASCE, 105, 1076-1095.

"Plate Dowels an innovation driven by industrial concrete paving," American Concrete Pavement Association, April 2010

Porter, M. L., Guinn, R. J., and Lundy, A. L., "Dowel Bar Optimization: Phase I and II", Center for Transportation Research and Education, October 2001.

Schrader, E. K., "A solution to cracking and stresses caused by dowels and tie bars," Concrete International, pp. 40-45, July 1991.

Walker, W. W., and Holland, J. A., "Dowels for the 21st Century: Plate Dowels for Slabs on Ground," Concrete International, pp. 32-38, July, 1998.

BACKGROUND OF THE INVENTION

1. Field of the Invention

This invention relates generally to an assembly for transferring loads between adjacent cast-in-place slabs, and more particularly, to an improved system for transferring a load across a joint between a first and a second slab, the load being applied to either slab.

2. Related Art

Typical floors in industrial buildings, roads, driveways, sidewalks, and other, are constructed using concrete. However, in the curing process, concrete shrinks and internal stresses develop, negatively affecting the performance of such floors. To overcome the concrete shrinkage problem, joints or breaks are inserted in the concrete, as shown in FIG. 1A. The concrete floor is divided into a series of blocks or slabs. Joints, typically spaced at 20 ft, accommodate any concrete shrinkage at the expense of breaking the continuity of the floor. To restore the continuity of the slab at a joint, load transfer devices can be used to distribute the applied loads between the first and second slabs across the joint.

Several steel dowel bars or plates were proposed to bridge the joint gap between adjacent concrete slabs. Traditional round steel dowel bars, as shown in FIG. 1B have the main disadvantage of restraining relative movement of the adjacent slabs parallel to the joint. As round steel dowels are all around encased in concrete, any relative movement between concrete slabs parallel to the joint is prevented, as shown in FIG. 2B. This contributes to the formation of restraint cracks in the concrete. In addition, any misalignment in placement of round dowels can lock the joint by preventing any movement perpendicular to the joint surface from occurring, as shown in FIG. 2A.

U.S. Pat. No. 4,733,513 and No. 6,145,262 issued to Schrader et al. introduced square steel dowel bars, as shown in FIG. 1C, equipped with sheaths and compressible material along the vertical sides. The use of a combination of square dowels and compressible material allowed for some relative movement between adjacent slabs parallel to the joint, but to a limited extent. The compressible material within the sheaths did not provide enough tolerance for relative movement parallel to the joint.

Given that most load transfer occurs in the vicinity of the joint, a major shortcoming of previously disclosed dowels is the use of a dowel with homogeneous section. Previously disclosed dowels placed relatively insufficient steel material along the joint where most of the load transfer occurs, and more than required material away from the joint, where the dowel is relatively minutely loaded.

U.S. Pat. No. 6,354,760, No. 7,481,031, No. 7,716,890, and No. 0,014,018 issued to Boxall et al., disclosed the use of diamond, tapered, and rectangular plates, respectively, for load transfer, as shown in FIGS. 3A-3C. The introduction of steel plates for load transfer enabled an increase in the contact area between the steel dowel and concrete, thus reducing the corresponding stresses along the aforementioned contact area. Furthermore, the design of sleeves for plate dowels provided some extra space along the vertical sides of the plate in order to allow for relative slab movement parallel to the joint. As a result, steel plates were able to slide parallel to the joint within the corresponding sleeve without any restraining force.

Diamond dowels, that constitute square steel plates with their largest dimension, or diagonal, positioned along the joint line, as shown in FIG. 3B, are common in the industry. In addition to the above mentioned advantages, the shape of diamond dowels is optimized in order to provide the highest amount of steel material in the highly stressed region in the vicinity of the joint and less steel material away from the joint where stresses are reduced. However, the performance of diamond dowels is limited by several factors, particularly for relatively wide joint widths. Due to the tapered vertical sides of the diamond dowel, and the fact that the dowel is embedded in the concrete on at least one side, the concrete-steel contact area drops as the joint width increases. Hence, diamond dowels become less effective in transferring the load across the joint between adjacent slabs as the joint gap widens.

SUMMARY OF THE INVENTION

A tapered dowel bar for transferring loads across a joint between adjacent cast-in-place concrete floor slabs is disclosed. The dowel may taper on both sides of the joint from a relatively wide central cross-section along the joint line into relatively narrow or substantially pointed ends, over a predetermined embedment depth. Alternatively, the dowel may taper along its length from one relatively wide end to another relatively narrow end. The embedment depth within each adjacent slab is approximately equal to half the length of the generally tapered dowel. A plurality of cross sections, including circular, rectangular, square, elliptical, or other, may be used.

A socket assembly, that comprises a casing that could be essentially made of steel and filled with any core material, preferably high-strength concrete, is included. The socket assembly is designed such that the tapered surfaces of the dowel can be perfectly embedded within the material filling the casing. The tapered surfaces of the dowel should be essentially attached to the surfaces of the void space in the material filling the casing. The casing, preferably made of steel, should have essentially planar horizontal and vertical surfaces. The top and bottom surfaces of the casing should be essentially horizontal, and may or may not taper. In case the top and bottom surfaces taper, the taper should preferably follow that of the dowel bar. The depth of the socket assembly is essentially slightly more than half the length of the dowel.

This invention also comprises a pocket former, preferably made of plastic, embedded in the concrete. The top and bottom surfaces of the pocket former should be essentially planar and horizontal in order to accommodate movement along the longitudinal axis of the dowel. The width of the pocket former, measured parallel to the joint line, should be adequately greater than the width of the socket assembly, such that the socket assembly can displace within the pocket former in a direction essentially parallel to the joint without any restraining forces. Compressible fins, or any other means, could be included to center the socket assembly within the pocket former. Compressible fins collapse upon loading, and allow the socket assembly to displace within the pocket former in a direction essentially parallel to the joint. The horizontal top and bottom surfaces of the pocket former could be essentially in contact with the corresponding top and bottom surfaces of the socket assembly in order to achieve proper load transfer.

The present invention can also be used without the pocket former. Instead, compressible material could be essentially attached along the vertical sides of the socket assembly, and an anti-friction material could be essentially applied along the top and bottom surfaces of the socket assembly in order to allow relative slab displacement parallel to the joint. The socket assembly equipped with compressible material along the vertical sides, or the socket assembly combined with a pocket former could be used on either or both sides of the joint.

The socket assembly and pocket former, or the socket assembly equipped with compressible material could be also used in combination with previously disclosed non-tapered dowel bars, essentially comprising, circular, square, elliptical, or any other cross section. This configuration would address the above-mentioned limitations of non-tapered traditional dowels by accommodating horizontal relative slab displacement essentially parallel to the joint.

OBJECTS AND ADVANTAGES

Accordingly, the present invention has several advantages over previously disclosed dowels bars and load plates. With respect to previously disclosed dowels, of circular, square, or other cross section, the present invention offers the additional advantages of (a) providing an optimized use of steel material along the dowel, and (b) accommodating for substantial relative displacement between adjacent slabs in a direction essentially parallel to the joint. With respect to previously disclosed diamond load plates, the present invention offers an additional advantage of maintaining a constant contact area between the steel and concrete in the slabs. This is particularly important for relatively wide joint widths. As the gap widens with concrete shrinkage, the socket assembly is attached to the dowel, and thus the contact area between the steel and concrete is substantially not reduced particularly when the top and bottom essentially planar surfaces of the socket assembly are not tapered.

Further objects and advantages of the present invention are to improve the performance of the dowel by embedding the tapered dowel into a durable material in the socket assembly. This would prevent the formation of voids along the concrete surrounding the dowel, voids that result in dowel looseness and corresponding loss of load transfer capacity of the dowel.

LIST OF REFERENCE NUMERALS

10—First concrete slab
12—Second concrete slab
14—Joint
16—Round dowel bar
17—Square dowel bar
18—Concrete shrinkage perpendicular to the joint
20—Relative slab movement parallel to the joint
22—Random stress relief cracks
24—Diamond load plate
28—Tapered load plate
30—Rectangular load plate
32*a*—tapered round dowel
32*b,c,d,e*—alternate embodiments of tapered dowel 32*a*
33—longitudinal axis of load transfer dowel
34*a*—First end diameter
34*b*—Second end diameter
36—Central diameter
39*b*—Rear diameter of void in core material
40*a*—Embedment depth within the first concrete slab
40*b*—Embedment depth within the second concrete slab
42—Void depth in core material
44—Casing
45—Socket assembly
46—Core material
48—Pocket former
50—Front width of socket assembly
52—Embedment depth of socket assembly
54—height of socket assembly
56—Rear width of socket assembly
58—Front width of pocket former
60—Rear width of pocket former
62—Embedment depth of pocket former
64—Void space
65—Void space
66—Compressible fins
67—Void space
68—Compressible material

DETAILED DESCRIPTION OF THE INVENTION

Figure 1A:
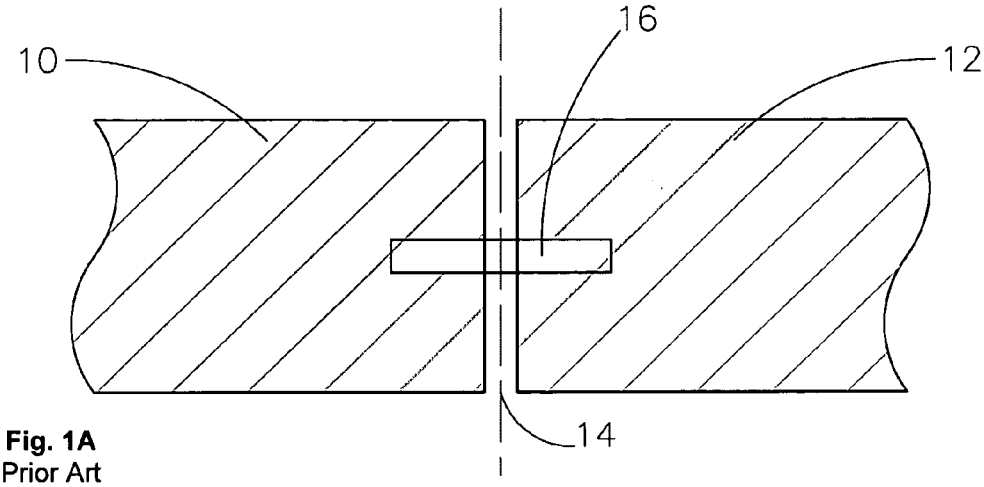
Fig. 1A Prior Art
FIG. 1A is a side view of a load transfer dowel between adjacent cast-in-place slabs.
Figure 1B:
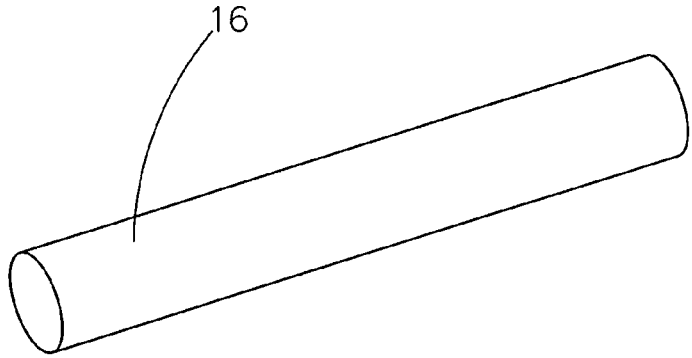
Fig. 1B Prior Art
FIG. 1B is an isometric view of a round dowel.
Figure 1C:
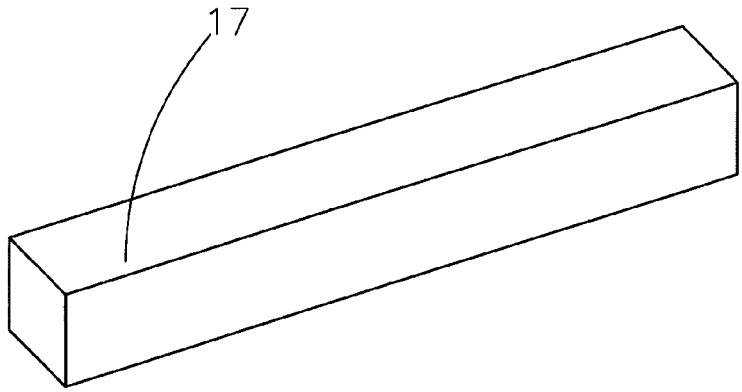
Fig. 1C Prior Art
FIG. 1C is an isometric view of a square dowel.
Figure 2A:
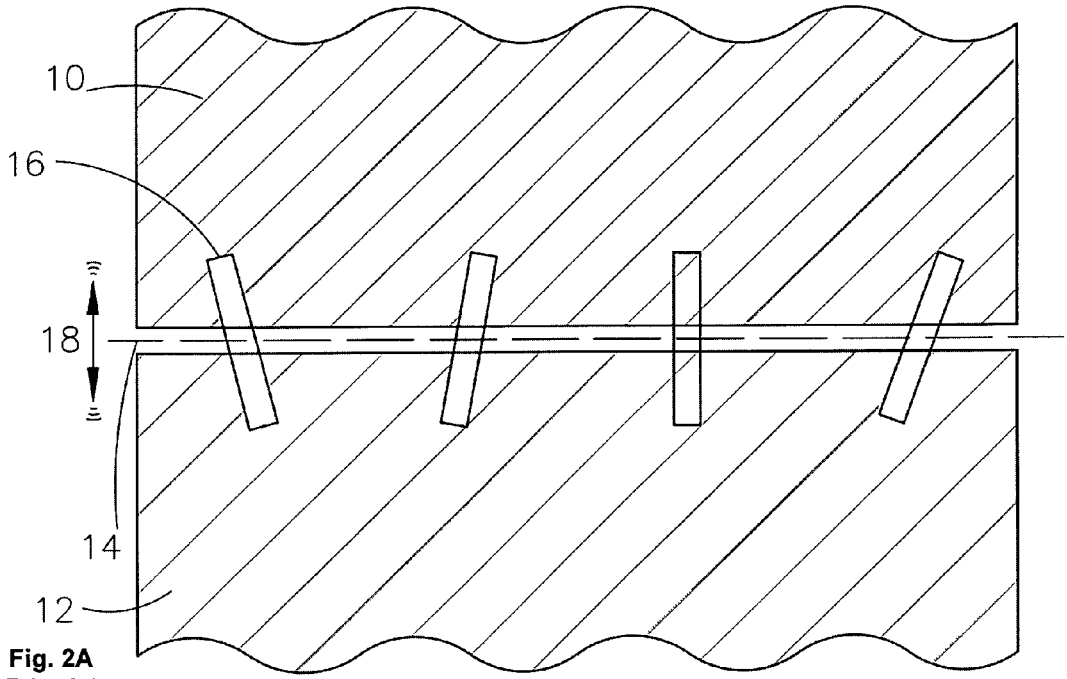
Fig. 2A Prior Art
FIG. 2A is a plan view of misaligned round dowels between adjacent slabs, causing slab cracking and joint locking.
Figure 2B:
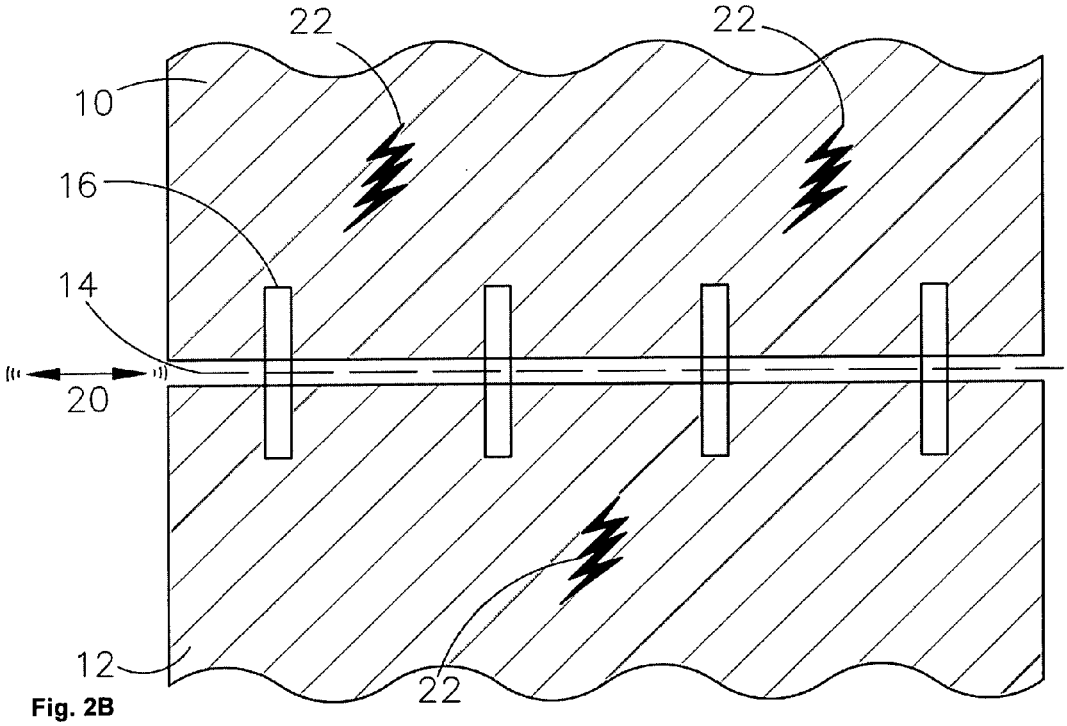
Fig. 2B Prior Art
FIG. 2B is a plan view of concrete slab cracking caused by round dowels that restraint relative movement parallel to the joint.
Figure 3A:
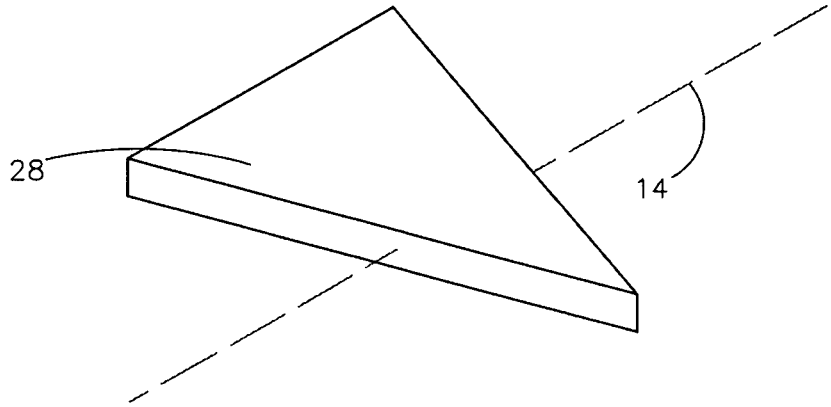
Fig. 3A Prior Art
FIG. 3A is an isometric view of a tapered load plate.
Figure 3B:
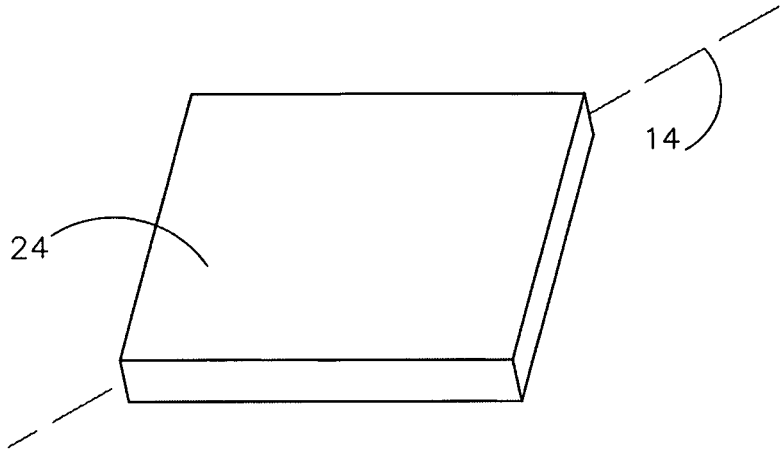
Fig. 3B Prior Art
FIG. 3B is an isometric view of a diamond load plate.
Figure 3C:
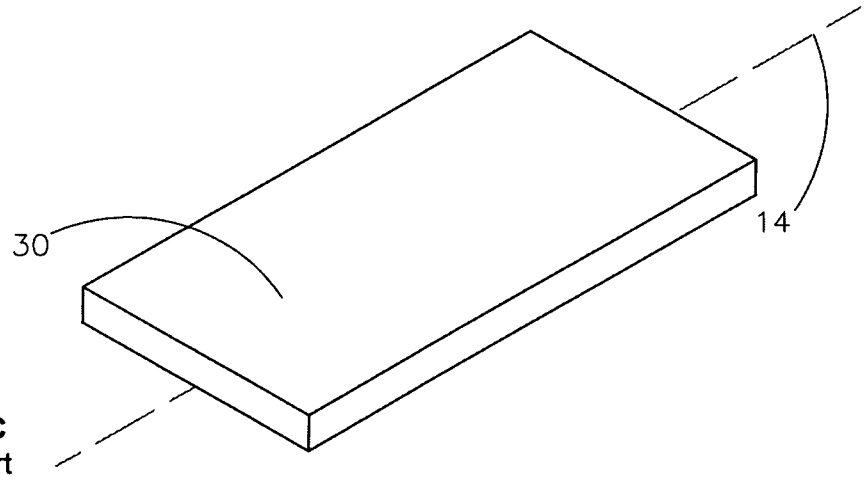
Fig. 3C Prior Art
FIG. 3C is an isometric view of a rectangular load plate.
Figure 4A:
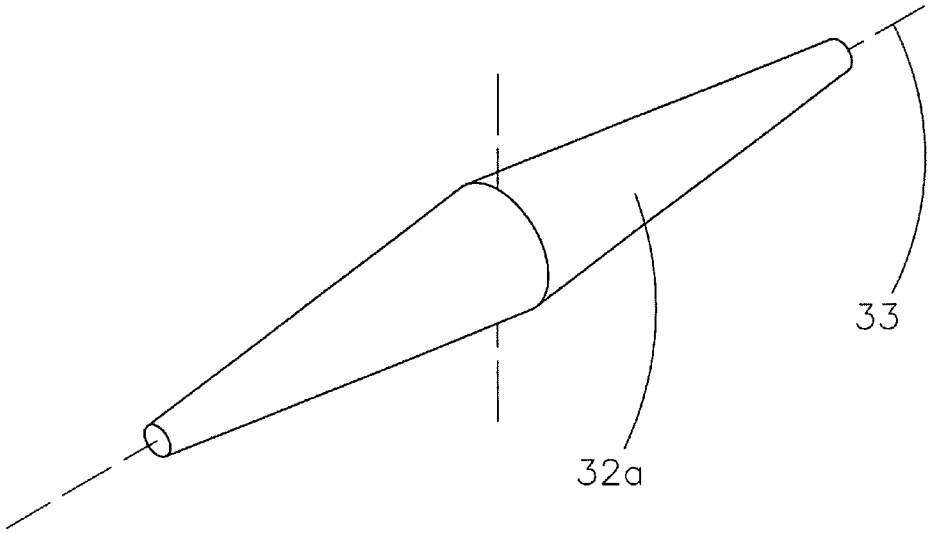
FIG. 4A is an isometric view of a tapered round dowel, in accordance with a specific embodiment of this invention.
Figure 4B:
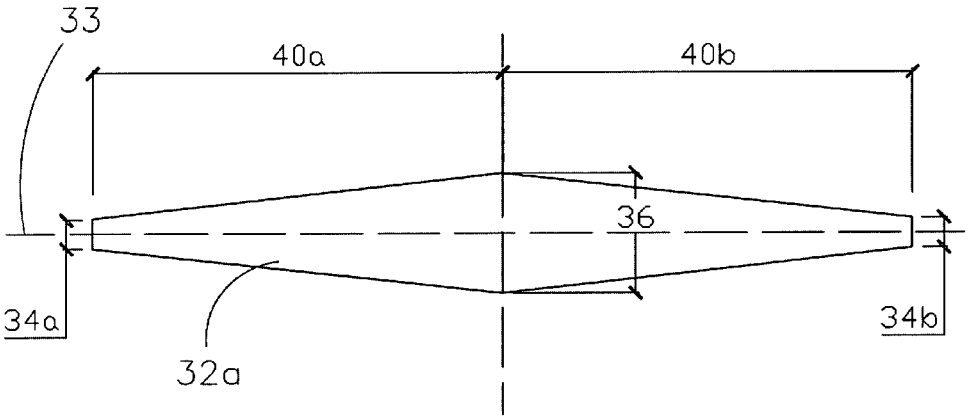
FIG. 4B is a side view of a tapered round dowel, in accordance with a specific embodiment of this invention.

Referring to FIG. 4, the round dowel 32*a* tapers on either or both sides from a central diameter 36 to substantially less end diameters 34*a,b* within the first concrete slab 10 and second concrete slab 12, respectively. One of the alternate possible embodiments of this invention comprises the use of pointed ends 34*a,b*, since the dowel material away from the joint is relatively unneeded. The tapered round dowel 32*a* has an embedment length 40*a,b* in the first concrete slab 10 and second concrete slab 12, respectively.

Figure 5:
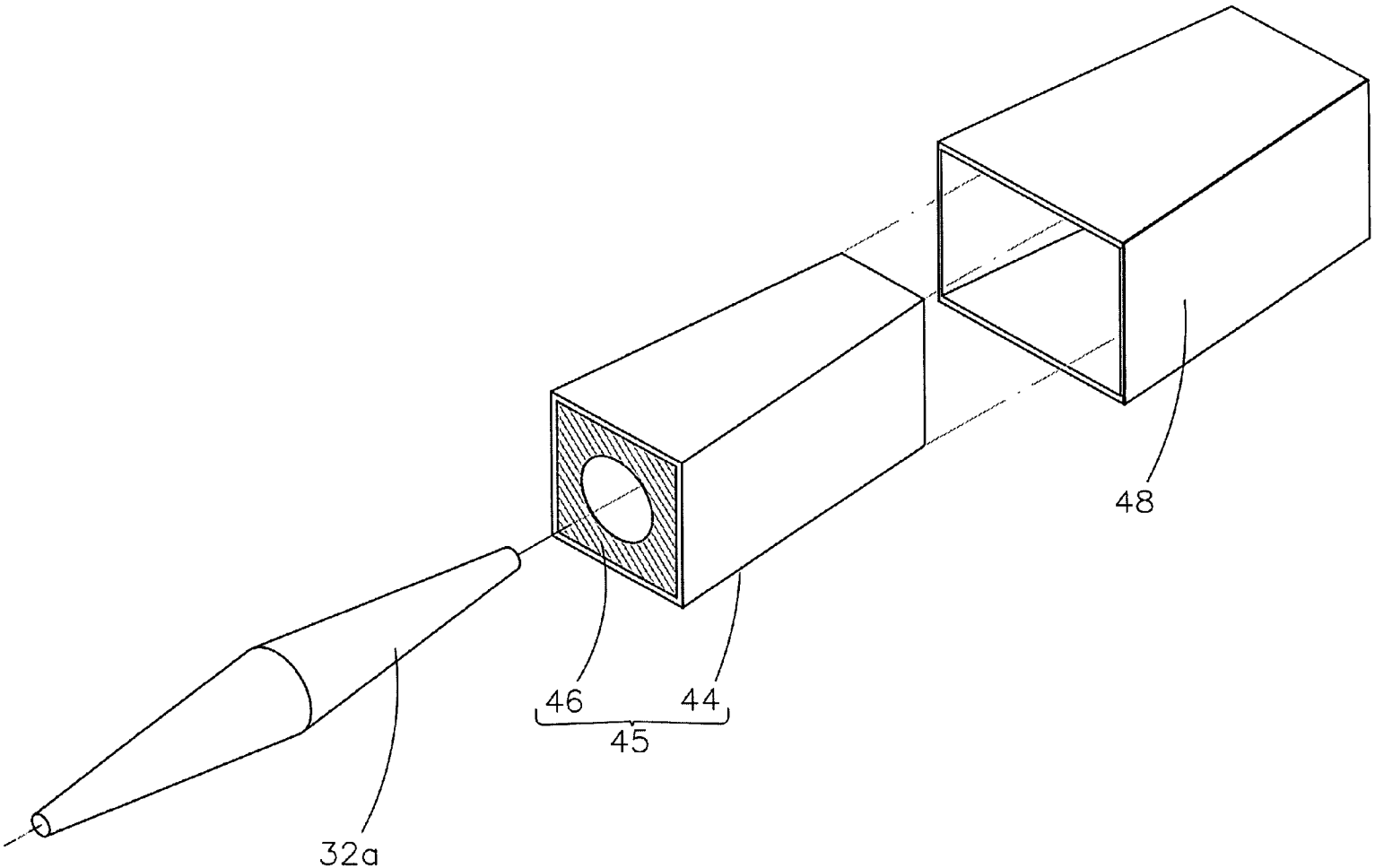
FIG. 5 is an exploded isometric view of a tapered round dowel, socket assembly, and corresponding pocket former, in accordance with a specific embodiment of this invention.

Referring to FIG. 5 that shows an exploded isometric view of the load transfer assembly, the tapered round dowel 32*a* is essentially embedded into a socket assembly 45. The socket assembly 35 comprises essentially a casing 44, preferably made of steel, filled with a core material 46, preferably hydraulic cement due to its high compressive strength, or any other appropriate material. One of the main purposes of the socket assembly 35 is to allow the tapered side or sides of the dowel to displace in directions parallel 20 and perpendicular 18 to the joint 14. The socket assembly 45 is positioned within a pocket former 48, preferably made of plastic material. The pocket former 48 and socket assembly 45 could be used on either or both sides of the joint 14.

Figure 6A:
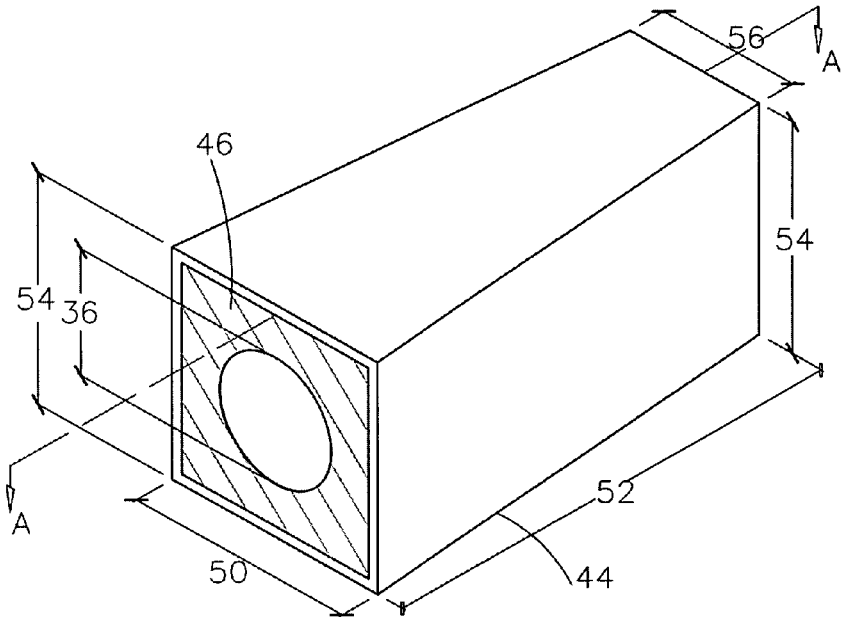
FIG. 6A is an isometric view of the socket assembly, in accordance with a specific embodiment of this invention.

FIG. 6A shows an isometric view of a socket assembly 45. The void space in the core material 46 has a front diameter 36 essentially equal to the central diameter of the tapered round dowel 32*a*, and a rear diameter 39*b* essentially equal to the end diameter 34*a,b* of the tapered round dowel 32*a*. If a dowel with different or no taper should be used, the shape of the void space in the core material 46 should be changed accordingly in order to maintain contact between the embedded tapered round dowel 32*a* and the material filling the core 46 of the socket assembly 45. The tapered dowel 32*a* can be attached to the socket assembly either during manufacture or on site. The front and rear height 54 should essentially be the same, making the top and bottom surfaces of the casing 44 essentially horizontal. The top and bottom surfaces of the casing 44 may or may not taper; in case tapered top and bottom casing sides are used, the taper could be essentially equal to the taper of the round dowel 32*a*.

Figure 6B:
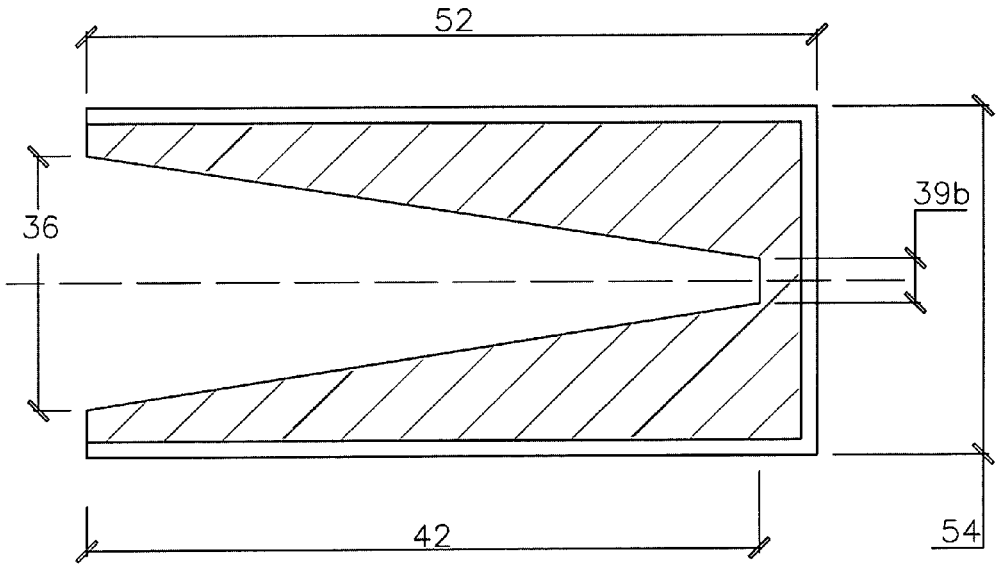
FIG. 6B is a cross-sectional view of the socket assembly along line A-A in FIG. 6A, in accordance with a specific embodiment of this invention.

FIG. 6B shows a cross-sectional view of the socket assembly along line A-A in FIG. 6A. The tapered sides of the dowel 32*a* should be essentially attached to core material 46 filling the casing 44 of the socket assembly 45. Any means for attaching the tapered dowel 32*a* to the core material 46 could be used.

Figure 7A:
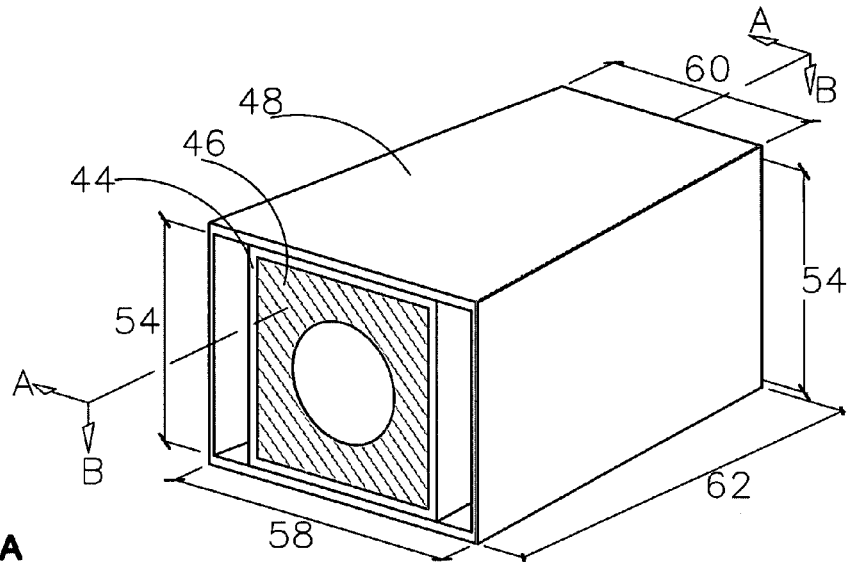
FIG. 7A is an isometric view of the pocket former, in accordance with a specific embodiment of this invention.
Figure 7B:
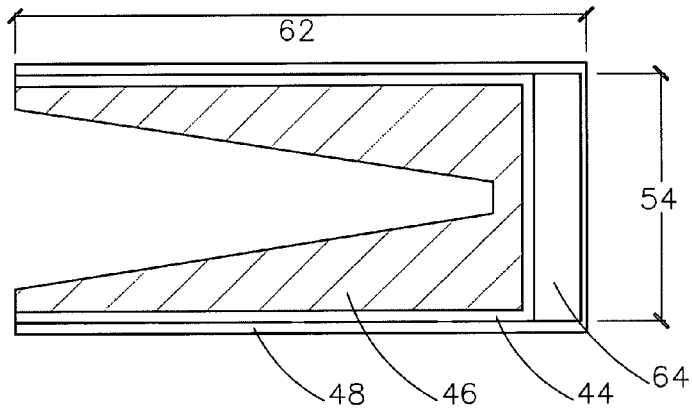
FIG. 7B is a cross-sectional view of the pocket former and socket assembly along line A-A in FIG. 7A, in accordance with a specific embodiment of this invention.

Referring to FIG. 7A, the pocket former 48 embedded in the concrete has a front width 58 and rear width 60 essentially higher than the corresponding front width 50 and rear width 56 of the socket assembly 45 in order to allow for relative movement parallel to the joint 14. The inner front and rear depths of the pocket former 48 should be essentially equal to the outer depth 54 of the socket assembly 45. Referring to FIG. 7B that shows a cross-sectional view along line A-A in FIG. 7A, the embedment depth 62 of the pocket former 48 could be essentially slightly higher than the depth 52 of the socket assembly 44 in order to accommodate for concrete slab shrinkage 18 perpendicular to the joint 14.

Figure 7C:
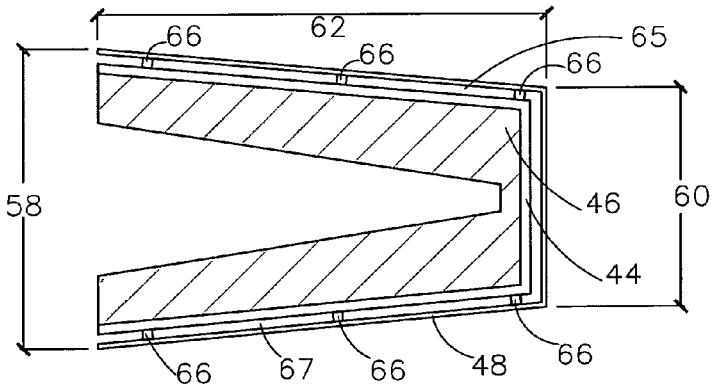
FIG. 7C is a cross-sectional view of the pocket former and socket assembly along line B-B in FIG. 7A, in accordance with a specific embodiment of this invention.

FIG. 7C is a cross sectional view along line B-B in FIG. 7A showing a socket assembly 45 positioned in the pocket former 48. Void spaces 65 and 67 should essentially be left on the sides of the socket assembly in order to account for relative slab displacement 20 parallel to the joint 14. Collapsible fins 66, or any other appropriate alternatives, could be used to adequately center the socket assembly 45 within the pocket former 48.

Several methods for installing the load transfer device along the joint 14 could be used. Among other things, flanges could be included along the front edges of the pocket former 48 in order to attach the pocket former to the formwork. Those skilled in the art will know that other alternatives for attaching the pocket former to the formwork exist.

Once the concrete of the first slab 10 hardens, the formwork could be removed. The tapered round dowel 32*a*, attached to the socket assembly 45 could be then inserted into the pocket former 48 embedded in the hardened concrete of the first slab. A second socket assembly could be optionally attached to the tapered round dowel end that is not embedded in the concrete of the first slab. A second pocket former could be also optionally positioned along the second socket assembly. The use of a second socket assembly and second pocket former would allow for more tolerance for relative slab displacement 20 parallel to the joint 14, since extra void spaces 65,67 are added in the second pocket former. Alternatively, the concrete of the second slab 12 could be directly poured over the second end of the tapered round dowel, without the use of any second pocket former or second socket assembly.

Figure 8:
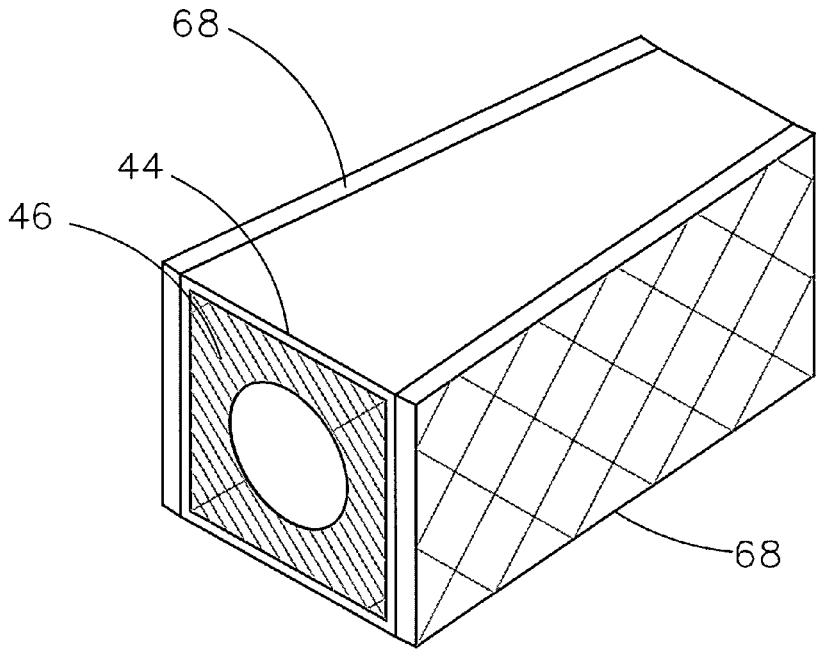
FIG. 8 is an isometric view of a pocket former equipped with compressible material along the vertical surfaces along the depth of the casing, in accordance with a specific embodiment of this invention.

A plurality of alternate embodiments of the proposed invention could be suggested. Referring to FIG. 8, the socket assembly 45 can be used without the pocket former 48. Instead, compressible material 68 could be essentially attached along the vertical surfaces along the depth of the socket assembly 45, and any anti-friction material could be essentially applied along the top and bottom surfaces of the socket assembly 45, in order to allow relative slab displacement 20 parallel to the joint 14 without restraining forces. The socket assembly equipped with compressible material 68 could be used on either or both sides of the joint 14.

Figure 9A:
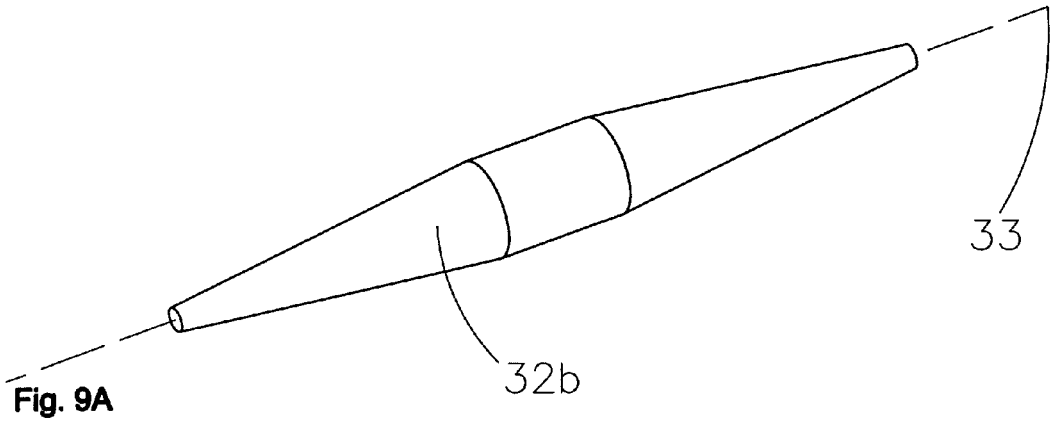
FIGS. 9A-D are isometric views of four possible alternate embodiments of the load transfer dowel bar in the proposed invention.
Figure 9B:
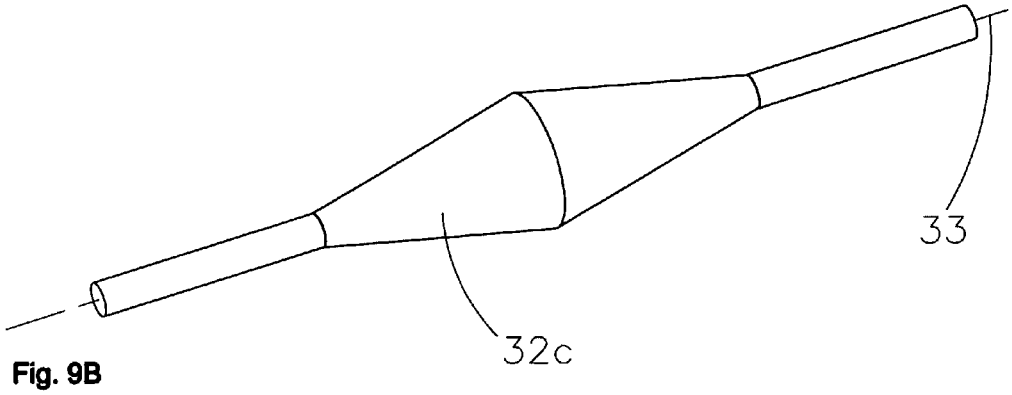
Figure 9C:
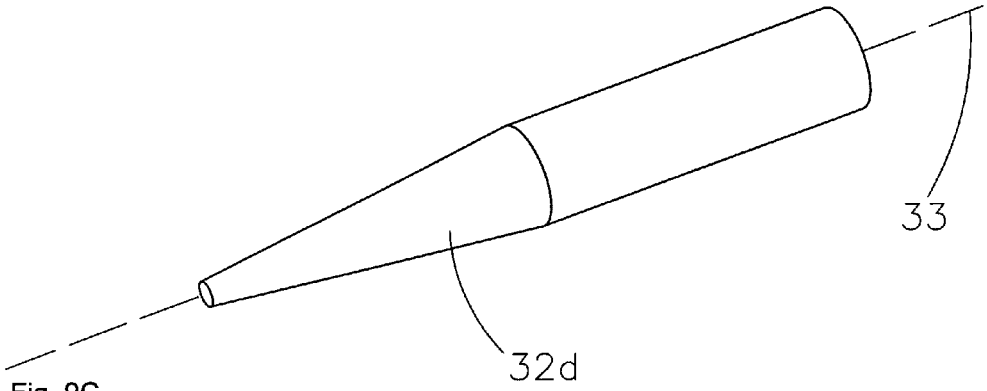
Figure 9D:
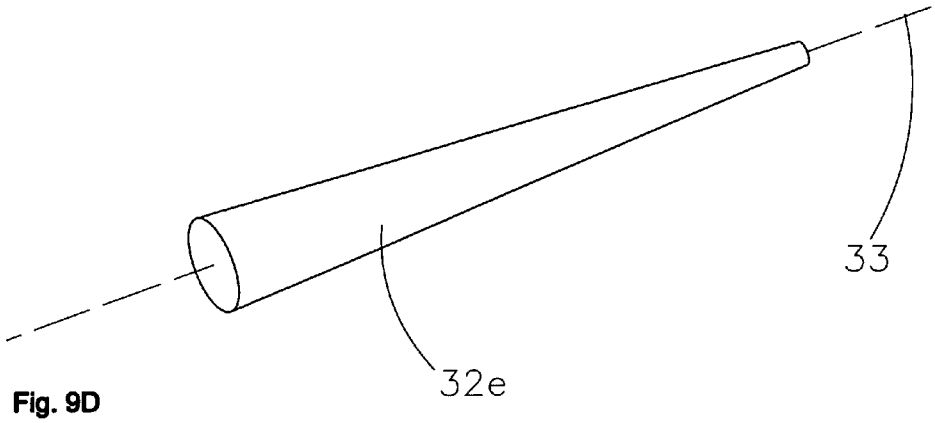

Referring to the aforementioned case of a tapered dowel for load transfer, the following suggestions can be made: (a) the tapered dowel can be directly embedded in the concrete on one side of the joint, and a socket assembly and pocket former used on the other side of the joint; the use of a socket assembly and pocket former on both sides of the joint would substantially double the tolerance for relative slab displacement parallel to the joint due to the added void spaces; (b) the taper of the dowel on each side of the joint could be different; (c) the tapered dowel could have a circular, rectangular, square, elliptical, or other cross section; (d) the dowel could taper from a relatively wide end into a relatively narrow or substantially pointed end along its length; (e) the dowel could have one or two tapered parts along its longitudinal axis, and no taper along the remaining parts of the longitudinal axis, as shown in FIG. 9; the non-tapered part of the dowel could be positioned along the central cross section of the dowel corresponding with the joint line, as shown in FIG. 9A, or could be positioned along the first and/or second ends of the dowel, as shown in FIGS. 9B-9C; alternatively, the dowel could taper along its length, from one relatively wide end, to one relatively narrow end, as shown in FIG. 9D(f) the socket assembly and pocket former or the socket assembly equipped with compressible material could be used with traditional circular, square, elliptical, or other non-tapered dowel bar shapes in order to accommodate horizontal slab displacement essentially parallel to the joint.

This invention has been described in accordance to specific examples and preferred embodiments. This invention includes all modifications that fall within the scope of the appended claims, and is therefore only limited by the following claims.

We claim:

1. A system for load transfer across a joint between adjacent cast-in-place concrete slabs, comprising:

a first cast-in-place concrete slab;

a second cast-in-place concrete slab;

a joint separating the first and second concrete slabs, wherein said joint is a plane oriented essentially perpendicular to a substantially planar upper surface of the first slab, and a longitudinal axis of said joint is formed by an intersection of said joint with the upper surface of the first slab;

a dowel bar for load transfer, with a longitudinal axis defined essentially perpendicular to the surface of the joint, and a cross section measured essentially perpendicular to said longitudinal axis, wherein the dowel has a predetermined length measured essentially perpendicular to said joint;

at least one socket assembly having essentially planar upper and lower surfaces;

at least one pocket former having means for positioning the socket assembly during installation;

whereby the load transfer assembly restricts relative movement between the first and second slabs in a direction substantially perpendicular to the upper surface of the first slab; provides unrestrained joint opening as the first and second slabs move away from each other in a direction substantially perpendicular to the joint; and allows for relative slab displacement in a direction substantially parallel to the longitudinal axis of the joint;

whereby the first end of said dowel bar protrudes into the first slab, and the second end protrudes into the second slab such that the dowel transfers a load between the first and second slabs, the load being applied to either slab.

2. The system of claim 1, wherein said dowel bar has an essentially circular cross section, and the corresponding diameter of said cross section is measured in a direction essentially parallel to said joint.

3. The system of claim 1, wherein said dowel tapers from one relatively wide cross section into one relatively narrow cross section, the taper being a generally progressive reduction of said cross section of said dowel bar over a predetermined portion of said length of said dowel.

4. The system of claim 3, wherein said cross section of said tapered dowel is circular, and the corresponding diameter of said cross section is measured in a direction essentially parallel to the joint.

5. The system of claim 3, wherein said dowel essentially tapers from the relatively wide cross-section into at least one substantially pointed end.

6. The system of claim 3, wherein said dowel has essentially one said tapered portion, along said length of said dowel.

7. The system of claim 3, wherein said dowel has essentially two said tapered portions, along said length of said dowel.

8. The system of claim 7, wherein said dowel tapers on both sides of the joint, with the relatively wide cross section essentially positioned along the joint and the relatively narrow ends within the first and second concrete slabs, and the dowel tapers progressively along each side of the joint.

9. The system of claim 8, wherein said taper of said dowel is different on each side of the joint.

10. The system of claim 1, wherein a plurality of compressible fins are used along the pocket former in order to adequately position said socket assembly within said pocket former.

11. An apparatus for load transfer across a joint between a first cast-in-place concrete slab and a second cast-in-place concrete slab, wherein said joint is defined by a surface essentially perpendicular to a substantially planar upper surface of the first slab, and longitudinal axis of said joint is formed by an intersection of said joint with the upper surface of the first slab; the apparatus comprising:

a first cast-in-place concrete slab;

a second cast-in-place concrete slab;

a dowel bar for load transfer, with a longitudinal axis defined essentially perpendicular to the surface of said joint, and a cross section measured essentially perpendicular to said longitudinal axis, wherein said dowel has a predetermined length measured essentially perpendicular to said joint;

at least one socket assembly having essentially planar upper and lower surfaces;

a compressible material essentially attached along the external vertical surfaces of the casing of the socket assembly;

whereby said dowel restricts relative movement between the first and second slabs in a direction substantially perpendicular to the upper surface of the first slab; maintains substantially adequate load transfer across the joint, provides unrestrained joint opening as the first and second slab move away from each other in a direction substantially perpendicular to the joint; and allows for relative displacement in a direction substantially parallel to the longitudinal axis.

12. The system of claim 11, wherein said dowel bar has an essentially circular cross section, and the corresponding diameter of said cross section is measured in a direction essentially parallel to said joint.

13. The system of claim 11, wherein said dowel tapers from one relatively wide cross section into one relatively narrow cross section, the taper being a generally progressive reduction of said cross section of said dowel bar over a predetermined portion of said length of said dowel.

14. The system of claim 13, wherein said cross section of said tapered dowel is circular, and the corresponding diameter of said cross section is measured in a direction essentially parallel to the joint.

15. The system of claim 13, wherein said dowel essentially tapers from the relatively wide cross-section into at least one substantially pointed end.

16. The system of claim 13, wherein said dowel has essentially one said tapered portion, along said length of said dowel.

17. The system of claim 3, wherein said dowel has essentially one said tapered portion, along said length of said dowel.

18. The system of claim 17, wherein the dowel tapers on both sides of the joint, with the relatively wide cross section essentially positioned along the joint and the relatively narrow ends within the first and second concrete slabs, and the dowel tapers progressively along each side of the joint.

19. The system of claim 18, wherein said taper of said dowel is different on each side of the joint.

20. The system of claim 11, wherein a plurality of compressible fins are used along the pocket former in order to adequately position the socket assembly within the pocket former.

* * * * *